US006106374A

United States Patent [19]

Boggs et al.

[11] Patent Number: 6,106,374

[45] Date of Patent: Aug. 22, 2000

[54] ACOUSTICALLY AGITATED DELIVERY

[75] Inventors: Karl E. Boggs, Poughkeepsie; Leonard C. Stevens, Poughquag, both of N.Y.

[73] Assignee: International Business Machines Corporation, Armonk, N.Y.

[21] Appl. No.: 09/116,792

[22] Filed: Jul. 16, 1998

[51] Int. Cl.[7] ..... B24B 57/00

[52] U.S. Cl. ..... 451/60; 451/446; 366/127

[58] Field of Search ..... 451/60, 446, 41; 137/828; 366/127, 154.2, 114

[56] References Cited

U.S. PATENT DOCUMENTS

| | | | |
|---|---|---|---|
| 1,734,975 | 11/1929 | Loomis et al. . | |
| 2,578,505 | 12/1951 | Carlin | 366/127 |
| 3,406,302 | 10/1968 | Lanyi et al. | 366/127 |
| 3,433,461 | 3/1969 | Scarpa | 366/127 |
| 3,575,383 | 4/1971 | Coleman | 366/127 |
| 5,123,433 | 6/1992 | Fridsma et al. | 134/104.1 |
| 5,245,796 | 9/1993 | Miller et al. . | |
| 5,399,234 | 3/1995 | Yu et al. . | |
| 5,531,861 | 7/1996 | Yu et al. . | |
| 5,741,173 | 4/1998 | Lundt et al. | 451/56 |
| 5,904,332 | 5/1999 | Lindbeck | 366/114 |

FOREIGN PATENT DOCUMENTS

| | | | |
|---|---|---|---|
| 353024172 | 3/1978 | Japan | 451/446 |
| 8-255774 | 10/1996 | Japan . | |

*Primary Examiner*—Robert A. Rose

*Attorney, Agent, or Firm*—McGinn & Gibb, P.C.; Daryl K. Neff, Esq.

[57] ABSTRACT

A chemical mechanical polishing apparatus comprises a delivery system for supplying a slurry, wherein the slurry includes suspended particles and at least one acoustic element, connected to the delivery system, the acoustic element generating sound waves for agitating the slurry and maintaining the particles in suspension.

24 Claims, 3 Drawing Sheets

ACOUSTICALLY AGITATED DELIVERY

BACKGROUND OF THE INVENTION

1. Field of the Invention

The present invention generally relates to processes for increasing production yield during slurry polishing in semiconductor manufacturing and more particularly to processes which prevents solids from forming in the slurry.

2. Description of the Related Art

A common form of planarizing semiconductor substrates is chemical mechanical polishing (CMP). Chemical mechanical polishing, as its name suggests, utilizes both of the physical operation associated with polishing and the reactions associate with chemical compounds, to planarize a surface of a semiconductor device.

More specifically, as illustrated and FIG. 1, in chemical mechanical polishing, a delivery tube 10 supplies a slurry 11 to a polishing pad 12. The polishing pad 12 is rubbed against a surface to be planarized, such as a semiconductor substrate (not illustrated).

An important element of chemical mechanical polishing is the abrasive slurry 11. To maintain uniform polishing, the abrasive particles within the slurry 11 should remain consistently suspended throughout all areas between the polishing pad and the surface being polished. If the abrasives within the slurry join together and form solids, the surface being polished can be easily scratched by the solids.

As illustrated in FIG. 2, the force of gravity (indicated by the arrow 20) causes particles within the slurry 11 traveling within the delivery tube 10 to accumulate at the bottom of the delivery tube 10. This situation commonly occurs between polishing cycles, or at other times when the flow of the slurry 11 within the delivery tube 10 is stopped or slowed.

Indeed, the accumulation of the abrasive components and other particles within the slurry 11 may settle out and accumulate when a filter, such as a cartridge filter 30 illustrated in FIG. 3, is utilized. Such filters 30 are commonly designed to remove solids from the slurry. However, cartridge filters decrease the velocities of the slurry 11, which encourages an accumulation of particles, as is illustrated in area 31 of the cartridge filter 30.

When particles are permitted to accumulate, two major types of larger particles are formed. One type of gel-like accumulation is referred to as "flocculate" and a second type of harder accumulation of particles is referred to as an "agglomerate", both of which are illustrated in FIG. 4. Normal representations of dispersed particles are also illustrated in FIG. 4, for reference.

Conventionally, the problem of particle accumulation was solved by agitating the supply tank (not illustrated) which feeds the delivery tube 10. However, as mentioned above, when the velocity within the delivery tube 10 is reduced or stopped, particle accumulation will continue to occur regardless of the amount of agitation within the supply tank.

Additional conventional production techniques used to avoid the accumulation of solids includes the use of filters, such as the cartridge filter 30 shown in FIG. 3. However, as mentioned above, such a filter can actually promote particle accumulation because filters tend to reduce the velocity of the slurry within the delivery tube 10.

Further, filters simply stop solids and do not provide mechanisms for returning solids as dispersed particles to the slurry. Also, filters can become clogged and further reduce the velocity of the slurry, which, again, promotes particle accumulation.

For example, in the slurry for tungsten, the abrasive components will settle out and can flocculate/agglomerate if there is insufficient agitation. This situation exists in the delivery tube when, for example, the flow is interrupted during processing. The same problem occurs when filtering is attempted because the fluid velocity is too slow to agitate the suspension. The particle settling causes a variation in the solid content of the slurry as it is delivered. This variation in content results in a rate variation that degrades process control. As mentioned above, agglomerated slurry may contribute to scratching defects.

Conventional attempts to reduce solids within the delivery tube also include placing a filter at the very end of the tube which delivers the slurry to the pad 12. Such a filter is referred to as a "point of use" filter. In oxide polishing slurries, it has been found that point of use filters worked very well at removing large particles, thus helping to improve yield. Filters are also used in the recirculation loop (not illustrated) to remove gel particles that form as the slurry ages. Again, such a filter helps reduce foreign material defects on the product and increases projected yields.

Similar attempts have been made to use "point of use" filters on metal polishing slurries to remove large particles contaminating or forming within the slurry just before dispensing the slurry on the polishing pad. Unfortunately, metal polishing slurries, such as tungsten polishing slurry, are not colloidally stable and settle out of solution in the point of use filter.

Another conventional solution to the problem of solid formation involves the use of a very short delivery system without filtering. While such a system helps prevent the accumulation and variation in slurry composition, it does nothing to eliminate large particles and the growth of particles that contribute to scratch defects.

An additional conventional problem that occurs when the velocity is changed suddenly is that the particles which have previously settled out of the slurry, tend to rejoin the flow and increase the abrasive content being delivered. In other words, the conventional abrasive content is varied according to time and slurry flow history.

SUMMARY OF THE INVENTION

It is, therefore, an object of the present invention to provide a structure and method for preventing unstable slurries from settling in delivery systems by using acoustic energy to suspend the particles within the delivery system. By having a sonic, ultrasonic, or megasonic input connected externally to the delivery tube and/or filters the material is prevented from settling. Further, the acoustic energy breaks up particle associations that could lead to particle growth and, thus, prevents agglomeration. The abrasive concentration in the slurry is kept constant because accumulation in filters is also prevented.

The invention includes a chemical mechanical polishing apparatus comprising a delivery system for supplying a slurry, wherein the slurry includes suspended particles, and at least one acoustic element, connected externally to the delivery system, the acoustic element generating sound waves for agitating the slurry and maintaining the particles in suspension.

The invention also includes a polishing pad, wherein the delivery system has a point of use adjacent the polishing pad and the acoustic element is connected to the point of use of the delivery system.

The delivery system comprises at least one delivery tube and at least one filter, the at least one acoustic element comprising a plurality of acoustic elements, the acoustic elements being connected to at least one of the delivery tube and the filter.

The invention further includes a coupling material connecting the acoustic element and the delivery system, the coupling material transmitting the sound waves from the acoustic element to the slurry.

The acoustic element comprises one of an annular acoustic element, a semiannular acoustic element and a planer acoustic element. The acoustic element conforms to an external shape of the delivery system. The acoustic element is also positioned such that the sound waves travel in a direction opposite gravity. Additionally, the acoustic elements are positioned on the delivery system such that the sound waves agitate the slurry throughout the delivery system.

The invention also includes a delivery system for supplying a slurry in a chemical mechanical polishing apparatus, wherein the slurry includes suspended particles, the delivery system comprising at least one acoustic element, connected externally to the delivery system, generating sound waves for agitating the slurry and maintaining the particles in suspension.

The chemical mechanical polishing apparatus includes a polishing pad, the delivery system further comprising a point of use adjacent the polishing pad, the acoustic element being connected to the delivery system at the point of use.

The invention also includes at least one delivery tube and at least one filter, the at least one acoustic element comprising a plurality of acoustic elements, the acoustic elements being connected to at least one of the delivery tube and the filter. Further included is a coupling material connecting the acoustic element and the delivery system, the coupling material transmitting the sound waves from the acoustic element to the slurry.

The invention also includes a method for chemically-mechanically polishing a surface comprising supplying a slurry having suspended particles to a polishing pad using a delivery system, acoustically agitating the slurry in the delivery system, using at least one acoustic element, such that the particles remain suspended in the slurry, and polishing the surface using the polishing pad and the slurry.

The delivery system has a point of use adjacent the polishing pad and the step of acoustically agitating the slurry comprises a step of acoustically agitating the slurry at the point of use of the delivery system. The delivery system includes at least one delivery tube and at least one filter, the step of acoustically agitating the slurry in the delivery system including a step of acoustically agitating the slurry in at least one of the delivery tube and the filter. The delivery system also comprises a coupling material connecting the acoustic element and the delivery system, the step of acoustically agitating the slurry including a step of transmitting sound waves from the acoustic element to the slurry through the coupling material. Also, the step of acoustically agitating the slurry includes a step of supplying sound waves from the acoustic element in one of one of an annular pattern, a semiannular pattern and a planar pattern. Additionally, the step of acoustically agitating the slurry includes a step of supplying sound waves from the acoustic element shaped to conform to an external shape of the delivery system. Further, the step of acoustically agitating the slurry includes a step of supplying sound waves from the acoustic element in a direction opposite gravity. Additionally, the step of acoustically agitating the slurry includes a step of acoustically agitating the slurry throughout the delivery system.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
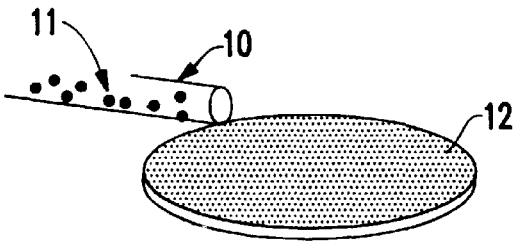
FIG. 1 is a schematic diagram of a conventional chemical mechanical polishing apparatus.
Figure 2:
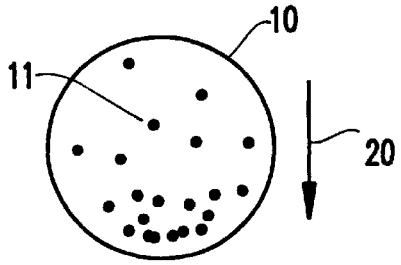
FIG. 2 is a schematic diagram of a cross-section of a delivery tube.
Figure 3:
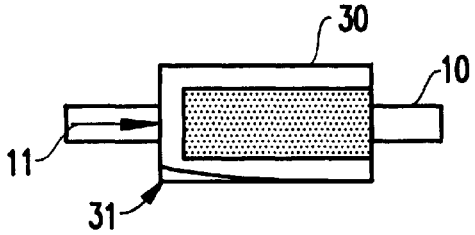
FIG. 3 is a schematic diagram of a cartridge filter.
Figure 4:
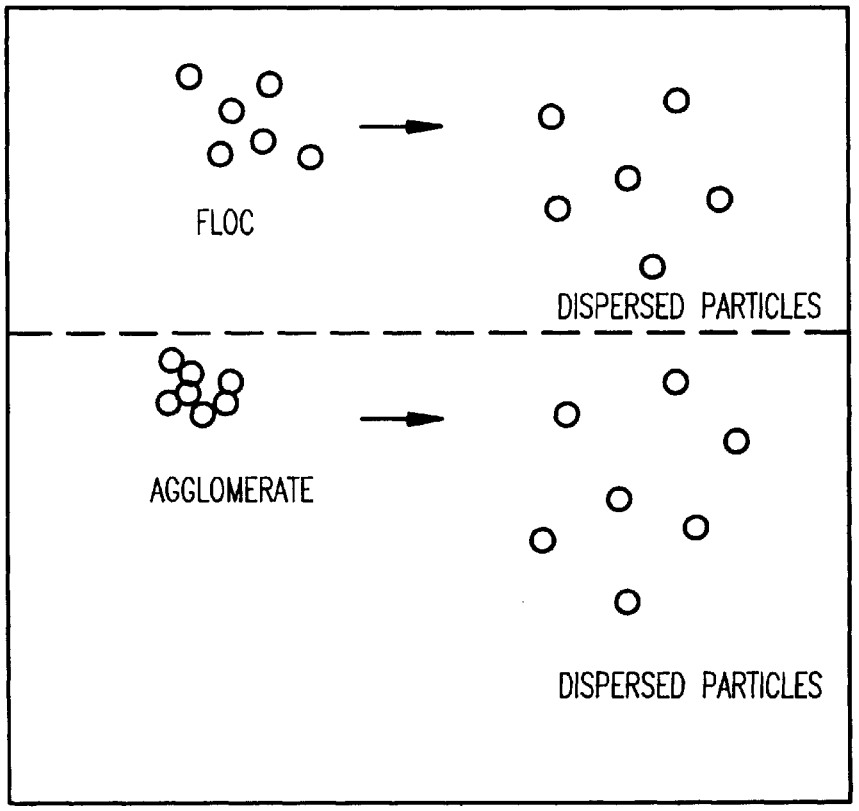
FIG. 4 is a schematic diagram illustrating particle accumulations.
Figure 5:
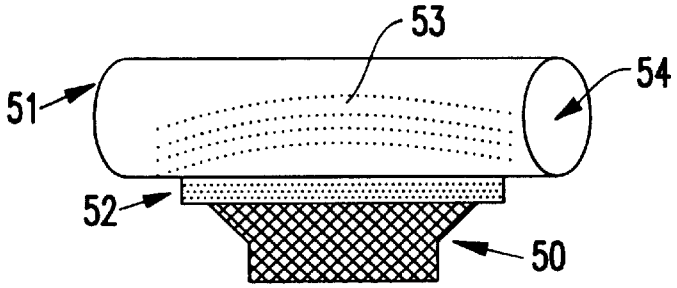
FIG. 5 is a schematic diagram of an embodiment of the invention including an acoustic device connected to a delivery tube.

Referring now to the drawings, and more particularly to FIG. 5, a first embodiment of the invention is illustrated.

More specifically, the invention includes a slurry delivery tube 51, an acoustic element 50 and a coupling material 52. The acoustic element 50 transmits sound waves 53 through the slurry 54 within the delivery tube 51. The sound waves 53 maintained an agitation within the slurry 54 which prevents particles from accumulating within the delivery tube 51.

Therefore, the invention prevents particles from accumulating (and prevents flocculation/agglomeration) within the delivery tube 51, even when the fluid velocity is slow or stopped.

As would be known by one ordinarily skilled in the art, any number of devices may be used as the acoustic element 50. The elements used to generate the sound waves 53 can include sonic elements and ultrasonic/megasonic elements.

Sonic elements preferably include small speakers driven by a sound source such as an oscillator, a buzzer, a mechanical tapper, etc. Ultrasonic/megasonic elements preferably consist of a piezoelectric transducer such as PZT (lead zirconium titanate) driven by a high frequency signal oscillator. Many of these elements are commercial available (e.g., speakers, transducers, etc.). The PZT transducers can be made to order using methods such as ceramic casting and sintering as would be known by those ordinarily skilled in the art.

The acoustic element 50 is joined to the delivery system 51 with the coupling medium 52, which could be an adhesive or other materials such as synthetic and silicone rubbers, reinforced plastic composites, cork, etc. Coupling materials are typically elastomeric materials that will conduct sound into the tube/filter without material degradation.

However, it is important to make the acoustic elements 50 removable so the delivery system can be replaced without having to dispose of the acoustic elements 50.

Many different geometries could accomplish the tasks of supplying sound waves 53 to the slurry 54, as would be known by one ordinarily skilled in the art given this disclosure. For example, the planar acoustic element 50 illustrated in FIG. 5 is affixed to a side of the delivery system 51, preferably on the underside, so that the acoustic energy works in direct opposition to gravity.

The shape of the acoustic element is preferably shaped to conform to the shape of the item to which the acoustic element will be attached. Therefore, for example, the shape of the acoustic element matches the cylindrical shape of the delivery tube and the elongated oval shape of the filter.

Figure 6:
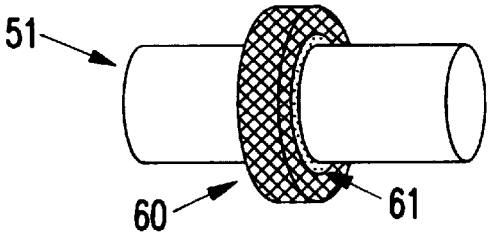
FIG. 6 is a schematic diagram of an embodiment of the invention including an acoustic device connected to a delivery tube.

Alternatively, as illustrated in FIG. 6, the acoustic element 60 comprises an annular transducer completely surrounding the delivery system 51. The annular transducer 60 is connected to the delivery system 51 by a compression fitting 61 and is mounted on the delivery tube 51 by sliding the acoustic element 60 along the delivery tube 51.

Figure 7:
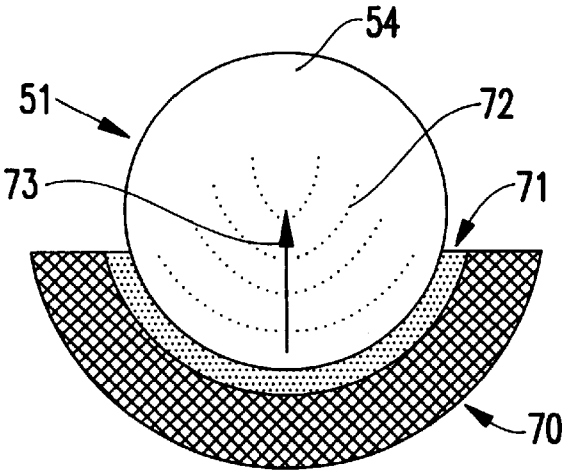
FIG. 7 is a schematic diagram of an embodiment of the invention including an acoustic device connected to a delivery tube.

Further, as illustrated in FIG. 7, another embodiment of the invention comprises a semiannular transducer 70 which partially surrounds the delivery system 51, preferably on the underside, as in the first embodiment. As with the previous embodiments, the semiannular transducer 70 is connected to the delivery system 51 with a coupling medium 71. The sound waves 72 are transmitted from the semiannular transducer 70 in the direction of arrow 73 to agitate the slurry 54 and prevents particle accumulations.

Figure 10:
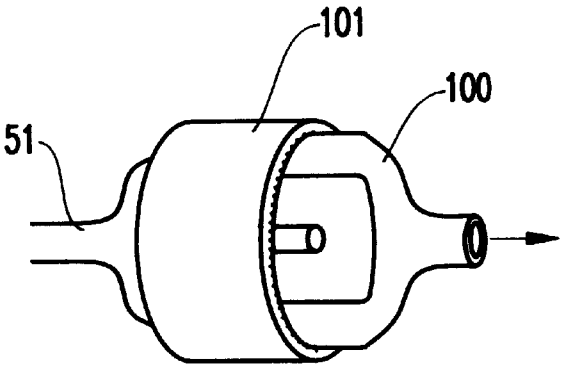
FIG. 10 is a schematic diagram of an acoustic device connected to a canisters filter according to the invention.

While the foregoing embodiments illustrate that the acoustic devices 50, 60, 70 are connected to the delivery tube 51, as would be known by one ordinarily skilled in the art given this disclosure, such acoustic devices could equally be connected to any other elements of the delivery system, such as filters and/or valves, orifices, vortex mixers, etc. For example, FIG. 10 illustrates a cartridge filter 100 surrounded by a cylindrical acoustical element 101. As with the previous embodiments, the acoustic element 101 generates sound waves which agitate the slurry within the cartridge filter 100 and prevent particle accumulations.

The acoustic elements which are connected to filters should be carefully selected such that the agitation created within the filter does not cause slurry penetration or filter breakthrough. Therefore, the sound waves generated by the transducer which is attached to a filter should be selected to allow the filter to still perform its function of stopping large particles and should not cause such large particles to bypass the filter.

Another embodiment of the invention applies acoustic agitation elements in sufficient number along the delivery system, in conjunction with filters, and at the point of use (polishing pad).

Figure 8:
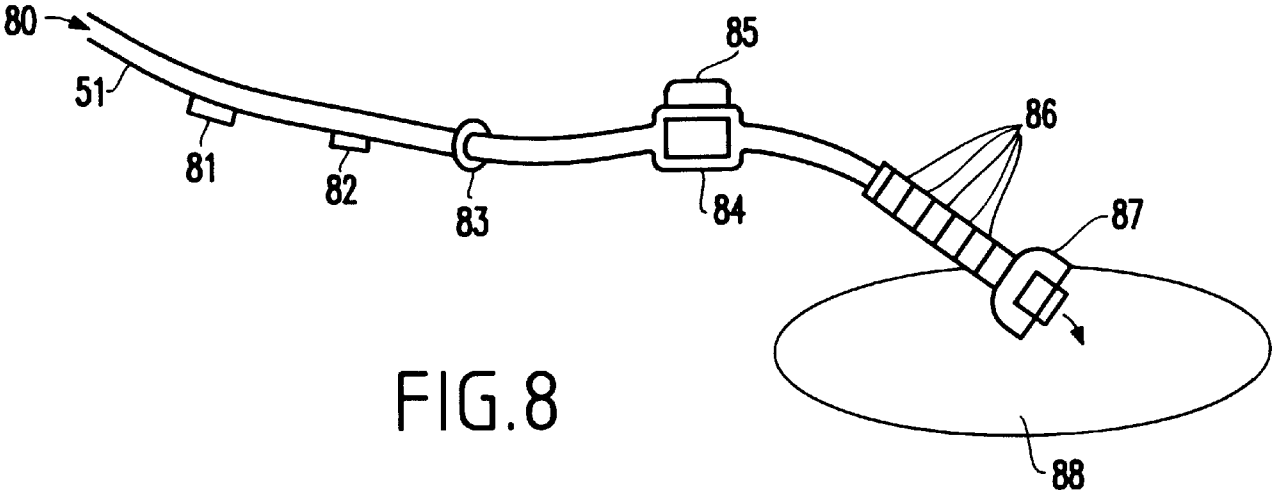
FIG. 8 is a schematic diagram of various acoustic devices connected to a delivery tube according to the invention.

More specifically, FIG. 8 illustrates a delivery system from a slurry source 80 to a pad 88, which includes a delivery tube with 51, a speaker 81, a transducer 82, a second transducer 83, a third transducer 85, a filter 84, a series of transducers 86 and a point of delivery transducer 87. As discussed with the previous embodiments, the speaker 81 and transducers 82, 83, 85–87 agitate the slurry traveling through the delivery tube 51 and prevent particles from accumulating.

To insure that the slurry being delivered to the polishing pad 88 contains as few solids as possible, the series of transducers 86 preferably comprise high power transducers. Therefore, the point of use acoustic device 86 produces sufficient agitation to maintain the particles currently suspended in the slurry and possibly enough agitation to break up the flocculated/agglomerated slurry prior to its delivery to the polishing pad 88.

Figure 9:
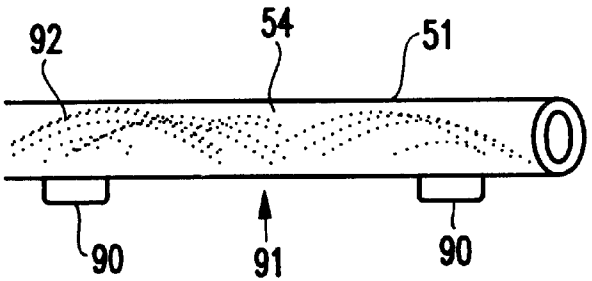
FIG. 9 is a schematic diagram of acoustic devices connected to a delivery tube according to the invention.

As illustrated and FIG. 9, with the invention transducers 90 are spaced along the delivery system 51 such that the sound waves 92 traveling through the slurry 54 sufficiently agitate the slurry along the entire length of the delivery tube the 51.

In other words, the sound waves from one transducer traveled down the delivery system 51 at least to the point to reach the other sound waves traveling in the opposite direction from an adjacent transducer. For example, in FIG. 9 area 91 represents an overlap where the sound waves from the transducers 90 overlap one another.

Therefore, with the invention, it is not necessary to line the entire delivery system with transducers. Instead, transducers can be spaced along the delivery system, depending upon the nature of the sound waves generated by the transducers, to insure that the entire length of the delivery system is agitated.

In light of the foregoing, it is clear that the invention overcomes many problems of conventional systems associated with particle accumulation. The invention provides a way to keep unstable (e.g., non-colloidal) slurries from settling in delivery systems, including filters, by using acoustic energy to suspend the particles within the pathway. By having an external sonic, ultrasonic, or megasonic input to the delivery tubing and filter units, the particles are prevented from settling out of the slurry. Further, the external acoustic devices break up particle associations that could lead to particle growth and agglomeration. The abrasive concentration in the slurry is also kept constant because the accumulation of particles in filters is prevented.

Limited particle growth and breakup of large particles improves yield through scratch reduction. Also, constant mixing (suspension) allows more stable polishing rates. This invention could be applied to other industries where unstable suspensions need to be transported without separation effects—these could include food processing, pharmaceuticals, petrochemical refining, plastics synthesis, etc. Indeed, the invention is useful with any unstable heterogeneous systems.

While the invention has been described in terms of preferred embodiments, those skilled in the art will recognize that the invention can be practiced with modification within the spirit and scope of the appended claims.

We claim:

1. A chemical mechanical polishing apparatus comprising:

a delivery system for supplying a slurry, wherein said slurry includes suspended particles;

at least one acoustic element, connected externally to said delivery system, said acoustic element generating sound waves for agitating said slurry and maintaining said particles in suspension; and a polishing pad, wherein said delivery system has a point of use adjacent said polishing pad and said acoustic element is connected to said point of use of said delivery system.

2. A chemical mechanical polishing apparatus comprising:

a delivery system for supplying a slurry, wherein said slurry includes suspended particles;

at least one acoustic element, connected externally to said delivery system, said acoustic element generating sound waves for agitating said slurry and maintaining said particles in suspension; and a polishing pad, wherein said delivery system comprises at least one filter, said acoustic element being connected to said filter.

3. The chemical mechanical polishing apparatus in claim 2, wherein said acoustic element breaks up agglomerated particles in said slurry.

4. The chemical mechanical polishing apparatus as in claim 1, further comprising a coupling material connecting said acoustic element and said delivery system, said coupling material transmitting said sound waves from said acoustic element to said slurry.

5. The chemical mechanical polishing apparatus as in claim 1, wherein said acoustic element comprises one of an annular acoustic element, a semiannular acoustic element and a planer acoustic element.

6. The chemical mechanical polishing apparatus as in claim 1, wherein said acoustic element conforms to an external shape of said delivery system.

7. The chemical mechanical polishing apparatus as in claim 1, wherein said acoustic element is positioned such that said sound waves travel in a direction opposite gravity.

8. The chemical mechanical polishing apparatus as in claim 1, wherein said at least one acoustic element comprises a plurality of acoustic elements and said acoustic elements are positioned on said delivery system such that said sound waves agitate said slurry throughout said delivery system.

9. A delivery system for supplying a slurry in a chemical mechanical polishing apparatus, wherein said slurry includes suspended particles, said delivery system comprising:

at least one acoustic element, connected externally to said delivery system, generating sound waves for agitating said slurry and maintaining said particles in suspension, wherein said chemical mechanical polishing apparatus includes a polishing pad, said delivery system further comprises a point of use adjacent said polishing pad, and said acoustic element is connected to said delivery system at said point of use.

10. A delivery system for supplying a slurry in a chemical mechanical polishing apparatus, wherein said slurry includes suspended particles, said delivery system comprising:

at least one acoustic element, connected externally to said delivery system, generating sound waves for agitating said slurry and maintaining said particles in suspension; and at least one filter, said acoustic element being connected to said filter.

11. The delivery system in claim 10, wherein said acoustic element breaks up agglomerated particles in said slurry.

12. The delivery system as in claim 9, further comprising a coupling material connecting said acoustic element and said delivery system, said coupling material transmitting said sound waves from said acoustic element to said slurry.

13. The delivery system as in claim 9, wherein said acoustic element comprises one of an annular acoustic element, a semiannular acoustic element and a planer acoustic element.

14. The delivery system as in claim 9, wherein said acoustic element conforms to an external shape of said delivery system.

15. The delivery system as in claim 9, wherein said acoustic element is positioned such that said sound waves travel in a direction opposite gravity.

16. The delivery system as in claim 9, wherein said at least one acoustic element comprises a plurality of acoustic elements and said acoustic elements are positioned on said delivery system such that said sound waves agitate said slurry throughout said delivery system.

17. A method for chemically-mechanically polishing a surface comprising:

supplying a slurry having suspended particles to a polishing pad using a delivery system;

acoustically agitating said slurry in said delivery system, using at least one acoustic element, such that said particles remain suspended in said slurry; and polishing said surface using said polishing pad and said slurry, wherein said delivery system has a point of use adjacent said polishing pad and said step of acoustically agitating said slurry comprises a step of acoustically agitating said slurry at said point of use of said delivery system.

18. A method for chemically-mechanically polishing a surface comprising:

supplying a slurry having suspended particles to a polishing pad using a delivery system;

acoustically agitating said slurry in said delivery system using, at least one acoustic element, such that said particles remain suspended in said slurry; and polishing said surface using said polishing pad and said slurry, wherein said delivery system comprises at least one filter, said step of acoustically agitating said slurry in said delivery system including a step of acoustically agitating said slurry in said filter.

19. The method in claim 18, wherein said acoustic element breaks up agglomerated particles in said slurry.

20. The method as in claim 17, wherein said delivery system comprises a coupling material connecting said acoustic element and said delivery system, said step of acoustically agitating said slurry including a step of transmitting sound waves from said acoustic element to said slurry through said coupling material.

21. The method as in claim 17, wherein said step of acoustically agitating said slurry includes a step of supplying sound waves from said acoustic element in one of one of an annular pattern, a semiannular pattern and a planar pattern.

22. The method as in claim 17, wherein said, wherein said step of acoustically agitating said slurry includes a step of supplying sound waves from said acoustic element shaped to conform to an external shape of said delivery system.

23. The method as in claim 17, wherein said, wherein said step of acoustically agitating said slurry includes a step of supplying sound waves from said acoustic element in a direction opposite gravity.

24. The method as in claim 17, wherein said, wherein said step of acoustically agitating said slurry includes a step of acoustically agitating said slurry throughout said delivery system.

* * * * *